United States Patent [19]

Tschirky

[11] 3,999,901

[45] Dec. 28, 1976

[54] PROGRESSIVE CAVITY TRANSDUCER

[75] Inventor: John E. Tschirky, Long Beach, Calif.

[73] Assignee: Smith International, Inc., Newport Beach, Calif.

[22] Filed: Nov. 14, 1973

[21] Appl. No.: 415,754

[52] U.S. Cl. ..... 418/48; 175/107

[51] Int. Cl.[2] ..... F01C 1/10

[58] Field of Search ..... 418/5, 48; 175/107

[56] References Cited

UNITED STATES PATENTS

| | | | |
|---|---|---|---|
| 2,505,136 | 4/1950 | Moineau | 418/48 |
| 2,898,087 | 8/1959 | Clark | 418/48 |
| 2,990,895 | 7/1961 | Works et al. | 175/107 |
| 3,112,801 | 12/1963 | Clark et al. | 175/107 |
| 3,159,222 | 12/1964 | Hammer et al. | 175/107 |
| 3,260,318 | 7/1966 | Neilson et al. | 175/107 |
| 3,802,803 | 4/1974 | Bogdanov et al. | 418/48 |
| 3,879,094 | 4/1975 | Tschirky et al. | 418/48 |
| 3,912,426 | 10/1975 | Tschirky et al. | 418/48 |

*Primary Examiner*—C. J. Husar

*Attorney, Agent, or Firm*—Subkow and Kriegel

[57] ABSTRACT

This invention relates to progressing cavity fluid motors with multiple stator elements connected in series to provide a fluid passageway from the input of the initial stator of the series to the output of the terminal stator of the series; the rotor elements in each stator are connected together for simultaneous rotation.

20 Claims, 9 Drawing Figures

PROGRESSIVE CAVITY TRANSDUCER

This invention relates to progressive cavity transducers composed of a helicoidal rotor and a completely helicoidal stator. When the rotor is rotated by an external force, the transducer acts as a pump, moving fluid from an inlet to an outlet connection to the stator. When the fluid is forced to flow between the stator and the rotor from the inlet to the outlet, the transducer acts as a motor delivering rotary power at the end of the rotor adjacent the discharge end of the fluid from the stator.

In a well-known form of such transducer, both when acting as pumps and when acting as motors, the stator is formed of an elastomer hereinafter referred to as a rubber, bonded to a steel housing.

When the transducer acts as a pump, rotation is imparted to a shaft to rotate the rotor; and fluid introduced at one end of the stator is pumped through the stator to an outlet connector to the stator. When fluid is forced into the stator between the rotor and the stator, it rotates the rotor, and the shaft connected thereto is then a power takeoff point. Since the rotor of the transducer rotates in an eccentric manner, moving from side to side inside the stator, it is necessary to convert this motion into a true rotation about a fixed axis so that power may suitably be imparted to or taken from the motor. This is accomplished by connecting the end of the rotor to a connecting rod by means of a universal joint and connecting rod to a shaft by means of a second universal joint to permit the shaft to rotate about a true axis. Such motors have been for many years used in bore-hole drilling (see the Clark U.S. Pat. No. 3,112,801, patented Dec. 3, 1963) and have been widely distributed by Smith International, Inc. under their registered trademark Dyna-Drill. Such motors are described in the article by H. M. Rollins "Bit Guiding Tools Provide Better Control of Directional Drills," *World Oil Journal*, 1966, pages 124–135; the Garrison U.S. Pat. No. 3,576,718, etc.

The use of such motors in bore-hole drilling, especially in drilling for oil and gas but also mining operations, have been a standard procedure in the art. Such motors are employed to rotate drills for boring in the earth. The motors may be used for an oil-field operation, such as tube cleaning, milling operations, and other conventional oil-field operations where it is desired to rotate a rod at the end of which a tool is to be rotated. Such motors are referred to as in-hole drills when designed to be run at the end of a pipe and adjacent to the drill bit. In the usual case, the rotor of the motor and the drill bit rotate with respect to a stator which, in turn is connected to the conventional drill string composed, in the case of the drilling of well bores, of a "kelly," drill pipe, and drill collar as required. The string extends to the surface with the kelly mounted in the rotary table. Where the in-hole motor is used in drilling, the liquid is the usual drilling fluid, i.e., mud or gas. It serves its usual function in the drilling operation, returning to the surface carrying the cuttings resulting from the drilling operation. For this purpose, it is necessary to provide the necessary fluid volumetric velocities (gallons per minute, G.P.M.) at the bit nozzles; and the necessary pressures at the nozzle so that cuttings may be moved through the annulus between the drill string and the bore hole wall and thus to the surface.

In motors used in connection with the earth-drilling operations, the pressure drop across the stator may be of the order of several hundred pounds with the drilling mud flow through the stator, from 300 to about 600 G.P.m., the total pressure at the outlet of the stator depending upon the depth, nature of the mud, size of the tool, design of the nozzles of the bit. The bit manufacturer usually supplies a recommended nozzle pressure drop to give the required lifting effect. It has been observed in transducers and particularly in motors which deliver a substantial torque effort at the drive shaft that the rubber of the stator frequently fails near the fluid outlet point of the stator, and this usually occurs in the lower third of the stators.

This effect appears to be related to the working of the rubber by the eccentric motion of the rotor and the magnitude of the pressure drop across the rotor. The resultant hysteresis in the rubber deleteriously affects the properties of the rubber.

An additional problem with rubber stators is in the influence of the geothermal effect. The temperature in the bore hole may range up to several hundred degrees F. above ground temperature, depending on the depth. This adds to the heat developed by the working of the rubber, due particularly to the low heat conductivity of the rubber, which is thus not readily carried away by the circulating mud.

Despite the cooling effect of the fluid, this temperature taken together with the working of the rubber which develops a hysteresis in the rubber, operates to impair the physical properties of the rubber. The result is a reduction in the life of the stator, and it is frequently necessary to replace stators with undue frequency which may be more frequent than any other effect requiring the withdrawal of the motor from operation and thus adding to the cost of operations.

The result is a loss of portions of the rubber which break away from the body of the rubber called "chunking" usually at its lower third or it may strip away from the encasing housing due to bond failure, or both may occur.

When this occurs, the motor must be disassembled and a new stator installed. This stator must, of course, have the necessary pitch to compliment the rotor and give the required pressure drop.

The torque developed is the greater the greater the effective pressure drop across the stator. For any given throughput, i.e., G.P.M., the pressure drop will be the greater the the greater the length of the stator, the less the leakage factor and the greater the diameter of the rotor which requires a greater diameter stator, all other design parameters being the same.

However, there is a practical limit on how large a stator can be fabricated due to difficulties in molding the stator and bonding the stator rubber to the housing.

Molding of the rubber to produce a successful bond to the housing and the necessary helical configuration at its surface becomes more difficult as the diameter of the stator and its length increase.

However, for many uses, it is desirable to develop a greater torque than is now practically available.

Where the motor is used as a down-hole motor in earth boring, as stated above, the requirements of the system include a sufficient flow, i.e., gallons/minute (G.P.M.) of mud or other fluid flow in order to establish the necessary velocity through the bit orifices and thus the desirable fluid velocity in the annulus to raise the detritus. This requires a sufficient pressure at the output of the stator so as to provide the necessary pressure and volumetric flow of the fluid at the bit nozzles.

Since for any fluid rate, gallons per minute, in any particular stator-rotor combination, the revolutions per minute (r.p.m.) is fixed, being directly proportional thereto, the torque is proportional to the pressure drop across the stator. These considerations influence the minimum pressure drop which can be tolerated and obtain the necessary fluid velocities and pressures at the bit nozzles.

In order to increase the torque, the product of the eccentricity (E) and the rotor diameter (D) and the stator pitch (P*s*) and the effective pressure drop ($\Delta p$) across the stator must be increased, since the torque is directly proportional to this product. In the case of oil-well or other bore-hole drilling, the size of the bore hole fixes the size of the diameter of the housing of the motor; and this, in turn, fixes the diameter of the rotor (D) and the eccentricity (E) which is practically available. The increase in the pressure drop ($\Delta p$) may be obtained by increasing the flow resistance through the stator by increasing the length of the stator. While this will result in an increase in the torque, it may be impractical because of molding problems. If the torque is increased by making the product ($E \times D \times Ps$) greater, the r.p.m. is decreased, at a constant G.P.M.

This dichotomy has introduced a practical limitation in the power available from motors of this character when used as bore-hole in-hole motors. This limitation taken with the reduction in stator life resulting from use of excessive pressure drop has been one of the limitations in this technology.

STATEMENT OF THE INVENTION

My invention also solves the problem by making the torque (T) and horsepower (HP) in the above transducers independent of the stator pitch length, rotor diameter, eccentricity and pressure drop across the rotor. It also to a large measure solves the problem of the deterioration of the rubber resulting in chunking and stripping and thus increases the life of the stator element. I may, contrary to the present designs of transducers, increase or decrease the r.p.m. or torque by independent changes in the design parameters, that is, the diameter of the rotor element (D), the pitch length of the stator element (Ps) the eccentricity (E), and the effective pressure drop across the stator ($\Delta p$) of the combinations. I, therefore, do not need to increase the rotor diameter, the stator pitch length or the eccentricity or the pressure drop across any stator to obtain the increased torque; and thus, I do not have to increase the diameter or the length of the stator elements. I may so vary the torque, increasing or decreasing the torque developed at any stator-rotor element independently of the r.p.m. at any G.P.M. I am thus able to independently produce the desired torque at any desired r.p.m.

An additional and cricital problem in the prior art transducer is the deterioration of the rubber resulting in the chunking of the rubber and the stripping away of the rubber from the housing, previously referred to. This, as I have found, is associated with excessive pressure drops across the stator, when the pressure required at the discharge from the stator is maintained at the level required by the service to which the transducer is applied. It is believed that this deterioration is a result of the working of the rubber which in addition to the loading of the rubber by the eccentric motion of the rotor described above results in the generation of heat and a deterioration of the rubber.

By reducing the pressure drop across the unitary stator-rotor combination of the prior art, while maintaining the same terminal pressure, that is, in a transducer used as an in-hole motor, when the pressure at the bit nozzles is maintained at the required value, an increase in the life of the stator results.

However, to accomplish this reduction in pressure drop in the prior art rotor-stator combinations, without changing the other parameters of the system, the torque which is developed is reduced. I may reduce the G.P.M. throughput and thus reduce the pressure drop, but this may be impractical because of other requirements for such throughput as described above. Furthermore, the reduction in the throughput, keeping the other design parameters constant, reduces the r.p.m.; and, therefore, the horsepower is reduced.

I accomplish this result by using a multiple stator-rotor combination connected in series. I connect the stators of the units in series so as to establish a flow path from the input to the initial stator through the succeeding stators to the output from the last stator of the series. The rotor of the first stator unit is connected to the rotor of the succeeding units in series so that the rotors rotate together. The last of the rotors in the sequence is connected by a universal joint to the shaft, which in a pump is the input power shaft and in the motor the output power shaft. In one form of my invention, each rotor is substantially the same length as the stator with which it cooperates; and the rotors are interconnected by means of universal joints and connecting rods. The terminal rotor is connected by a universal joint to the shaft.

In another form of my invention, the rotor in each stator is rigidly connected to the rotor in all the other succeeding stators and at its terminal end, as it exits the last of the stators, connected by universal joint and connecting rod to the shaft.

The diameter of the rotor (D), pitch length of the stator (P*s*), and eccentricity (E) of the stator rotor combination may be different where there is an individual rotor for each stator interconnected by universal joints. In such case, the torque developed may not be the additive effect of the individual torque. Unless the r.p.m. of each stator-rotor unit be the same, the lowest r.p.m. rotor will influence the r.p.m. of the others since the G.P.M. is the same. The r.p.m. at the shaft will be the result of the combination of the effects of the same flow velocity through the various stators and if the r.p.m. of the rotors are not equal, the resulting torque will not be equal to the sum of the torques which each of the units could have developed if run independently.

The above relationship between torque and pressure drop assumes that there is no by-pass of the fluid between the rotor and stator, that is, that all of the fluid passes through the progressing cavities. Any by-pass thus reduces the effective pressure drop ($\Delta p$). The hydraulic efficiency depends on the percentage of the G.P.M. which is fed to the stators which passes through the cavities. The effective pressure drop ($\Delta p$) is equal to the measured pressure drop across the stator ($\Delta p$) at the developed torque, multiplied by the efficiency, i.e., the leakage factor (K).

There are further practical difficulties arising from such interdependence if there is a difference in the r.p.m. of the individual rotor units. Since the r.p.m. is directly proportional to the gallons per minute for any rotor-stator design, any reduction in the r.p.m. at a given gallons-per-minute throughput will require the fluid to be forced through the stator between the stator and rotor while the remainder is passing through the progressing cavities at a reduced rate proportional to the lower r.p.m. This excessive leakage reduces the efficiency of the rotor, i.e., the value of K and reduces the available torque for the total G.P.M. Additionally, the rotors will be out of phase introducing excessive strains on the universal joints which will be required to accommodate and cancel out the differences in the individual r.p.m's and out-of-phase motions. The result will, of course, be a uniform r.p.m. for all rotor shafts but with leakage which may be excessive.

In these rotor-stator elements in which the required relationship between the design parameters and the G.P.M. does not exist, leakage will occur. I desire, therefore, that the r.p.m. of all of the units be substantially the same in the form in which the rotors are interconnected by universal joints. I, therefore, design the rotor-stator elements of the transducer so that the eccentricities of each stator-rotor element of the transducer be substantially the same, and the product ($D \times E \times Ps$) of the rotor diameter, eccentricity and stator pitch length for each stator rotor be substantially the same in each of the elements.

Since, however, the stator pitch length need not be the same if the diameter of the rotor and eccentricity are properly adjusted, the contribution of the torque output from each rotor-stator combination need not be the same although the r.p.m. is the same. The required torque is obtained by using the necessary number of elementary units.

In order to assemble the stators, it is desirable for convenience that the outer diameter of the housing be the same and that they are oriented with respect to each other so that they are circumferentially coincident. This may require an angular adjustment of the stator with respect to its axis so that the projection of its housing be coincident with an upper and a lower housing.

Since for practical reasons as described above, it is desirable to have all of the rotor-stator units interchangeable, the pressure drop across each unit will be substantially the same; since the fluid flow is the same in each unit, the torque contribution developed at each rotor-stator assembly will be the same and no undue twist will be developed at the universal joints when used.

Instead of using a separate rotor for each rotor-stator combination and connecting them by universal joints, I may use separate stators and rigidly interconnect the rotors passing through each of the stators. If the rotor is of uniform diameter throughout its length in each stator and the pitch length of each stator in which the rotor is positioned and the eccentricity of the rotor at each stator is the same, then the relation between the r.p.m. and the gallons per minute of fluid flow can be such as to minimize leakage.

The rigid rotor need not be of the same diameter or pitch in each of the units, but the eccentricity must be substantially alike in all of the units, provided, however, that the product of the eccentricity (E) and rotor diameter (D) and stator pitch ($Ps$) be substantially the same in each rotor-stator unit. Since the rotor pitch ($Pr$) is one-half of the stator pitch, where the stator pitch is different in any adjacent stator, the pitch of the rotor must bear the above relationship to the stator.

If the rigid rotors be different diameters or stators of different pitch ($Ps$), provided the eccentricity be substantially the same and, therefore, rotor elements be different designs in the various units, the rotor would need to be made of joined elements or machined into an intricate shape. Furthermore, the stator opening through which the rotor must be moved longitudinally will be smaller for the rotor section of smaller diameters; and interference may be encountered when such longitudinal displacement in assembly and use is necessary.

For this reason, I desire that in my preferred embodiment that the rigid rotor diameter be the same for all portions of the rotor in the stators and that the intermediate portions be not of greater effective diameters. Since it is desirable to avoid leakage, and since the rotors are necessarily all at the same r.p.m. being rigidly connected, it is desirable that the stator pitch and, therefore, the rotor pitch in the stators be all substantially the same. The eccentricity is the same for each rotor-stator combination.

This also makes the stators interchangeable, which is desirable.

The angular orientation of the stators is preferably adjusted in the manner described for the previously described form employing separate rotor elements. However, in this case, the central axis of the stators should preferably also be substantially coincident.

The torque developed by the assembly of the rotor-stator combinations is directly proportional to the design product ($D \times E \times Ps$) multiplied by the pressure drop from the inlet to the initial stator through the outlet of the terminal stator and is thus the sum of the pressure drop ($\Delta p$) across each of the stators, ignoring intermediate pressure drops between stators.

One of the practical advantages of the transducers of my invention is that any desired torque may be developed by adding rotor-stator stages. Each stage being of modest length, they may be readily molded by presently available molding techniques; as has been conventional in this art. While theoreticaly one unitary long stator may function to give the desired pressure drop and torque in the place of the multiple stators, this is a practical impossibility since there is a practical limit to the length of stators of practical eccentricity and pitch which modern rubber technology may produce.

By breaking the stator in small sections, the problem of molding rubber stators that will resist destruction is made easier than in the case of a long stator. Not only will the life of the stator be improved, the difficulty of molding the stator is minimized and the replacement of stators facilitated.

Should, however, failure occur in any stator employing my invention, it is merely necessary to strip the damaged stator from the rotor and replace it.

Since the total torque at subsequent rotors progressive increases, it may be desirable to make the rotors in the subsequent stators stronger to resist the increased torque. This may be accomplished by increasing the diameter of the rotor. It will be desirable to adjust the eccentricity and the stator pitch length to compensate for the increased rotor diameter. While the r.p.m. of the rotors are thus substantially equalized, the stators will not be interchangeable. However, since the tandem relationship is maintained, the ability to disassemble and replace stators is retained.

This invention will be described further in connection with the drawings of which FIG. 1 shows in schematic form the transducer of my invention employed a down-hole motor;

Figure 7:
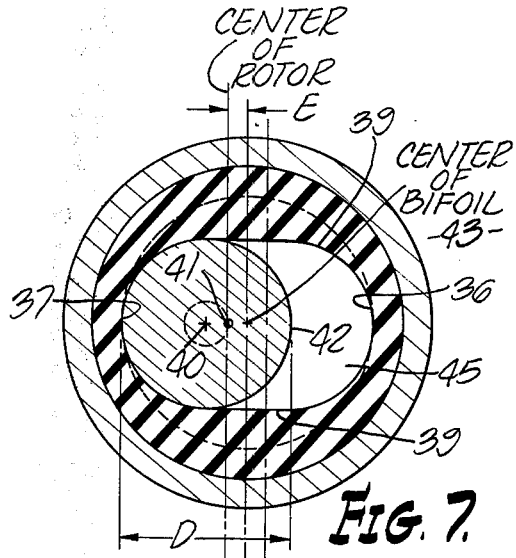
Figure 8:
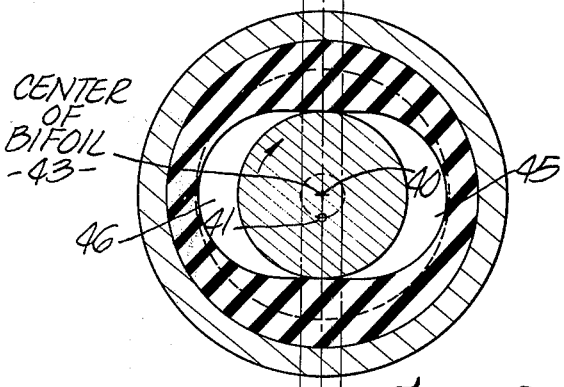
Figure 9:
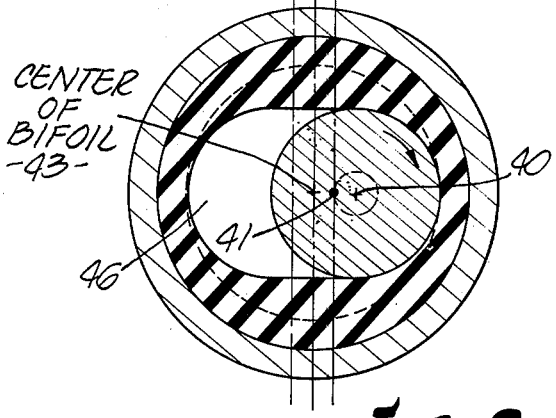

FIGS. 7, 8, and 9 show progressive positions of the rotor during one revolution of the rotor and further illustrate the design parameters.

Figure 1:
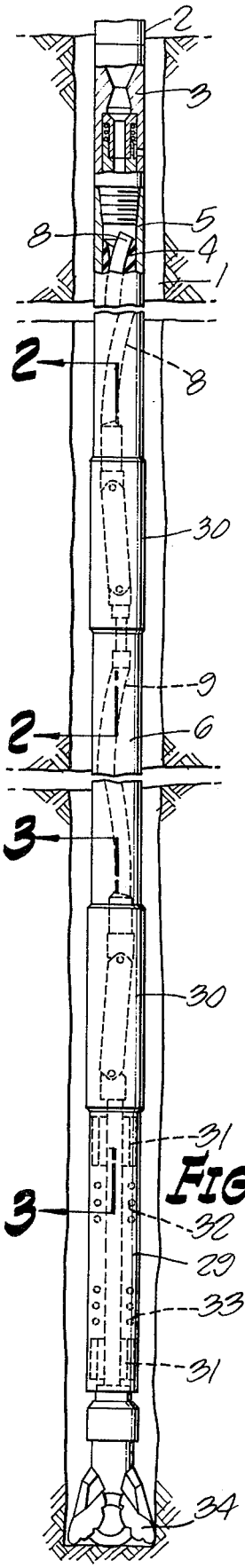
Figure 2:
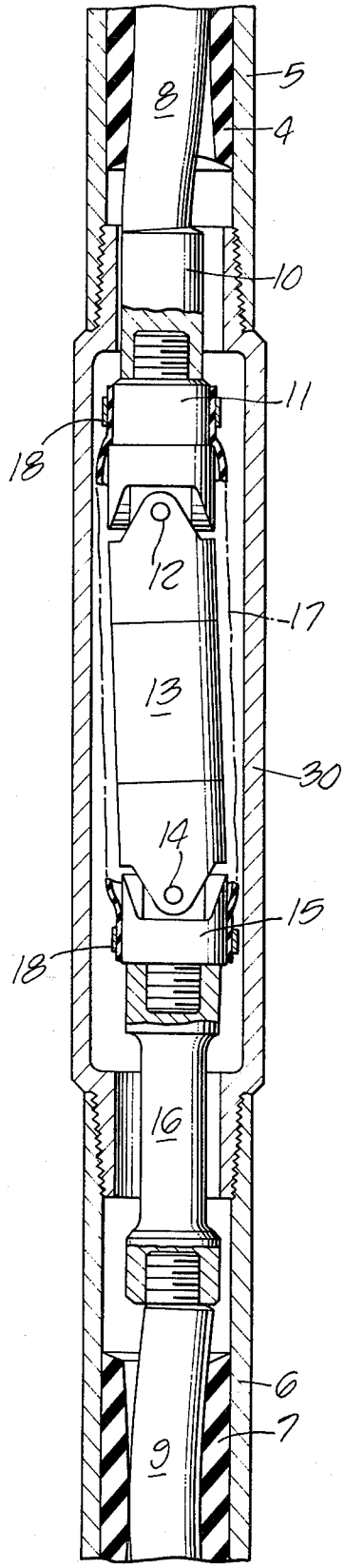
FIG. 2 and FIG. 3 illustrate a form of connection of the multiple stator and multiple rotor elements of the transducer useful for pumps and motors but shown specifically for use in down-hole motors.
Figure 3:
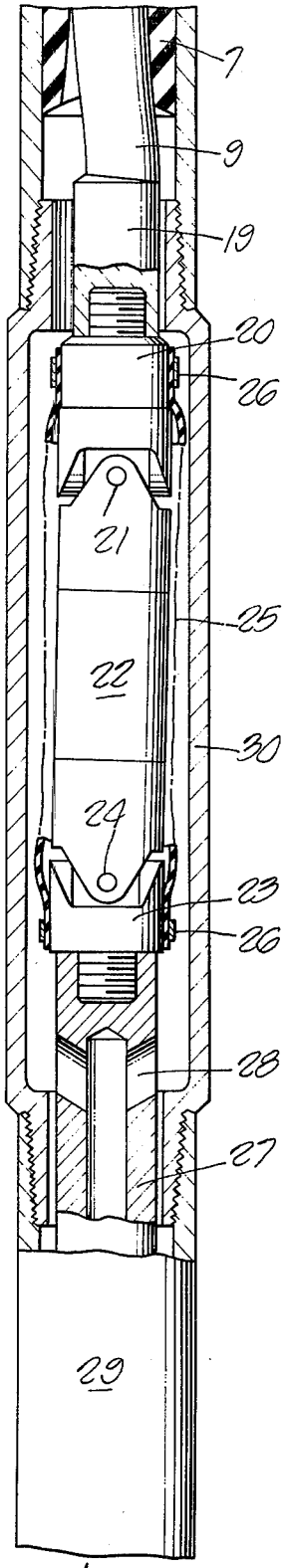

FIG. 1 shows schematically the arrangement of the Tandem Motor elements employed at the end of a drill string 2 in a bore hole shown at 1. The motor assembly is connected to the drill string through the by-pass valve 3. As shown in the schematic FIG. 1, the motor is composed of a plurality of stator-rotor assemblies forming elements of the motor. The stators 4 and 7, FIGS. 2 and 3, shown as two in number, may be increased to any desired number arranged serially as is illustrated by the broken lines on FIG. 1. Three or four or more of such stators may be assembled as described in connection with the two illustrated on FIGS. 1, 2, and 3.

These stators and the containing tubular housings 5 and 6 are of conventional design as is described in the previously mentioned references and as will be described more fully below. Each of the stators contains a rotor shown at 8 and 9. The upper end of the rotor 8 is free and not connected to any member. The lower end of the rotor 8 terminates in the cylindrical end 10 to which is connected the connector 11 which carries the universal joint 12. The universal joint may be as shown in the above Garrison patent or in the Neilson et al. U.S. Pat. Nos. 3,260,069 or 3,260,318. The universal joint 12 is connected to the connecting rod 13 which ends in a universal joint 14 which, in turn, is connected to the lower connector 15, screw connected to the rod 16. The connectors 11 and the universal joint 12 and connector 15, joint 14 and connecting rod 13 are encased in a boot 17, which is clamped to the connectors 11 and 15 by clamps 18. The rod 16 is screw connected to the rotor 9. The lower rotor 9 ends in a cylindrical extension 19 which is connected by the connector 20 to the universal joint 21, and the connecting rod 22 is connected to the connector 23 by the universal joint 24. The connectors 20 and 23 and universal joints 21 and 24 are encased in the boot 25 which are clamped to the connectors 20 and 23 by the clamps 26, similar to the previously described boot 17.

If additional rotor-stator assemblies are to be used in a down-hole motor, they may be connected to the connector 23 in a manner described in connection with the rotors 8 and 9. The lower connecting rod shown as 22, FIG. 3, or the lowest connecting rod if more than two stator-rotor assemblies are employed, is connected through the lowest connector, such as 23, to a hollow shaft 27, carrying ports 28. The hollow drive shaft is positioned within the housing 29 by means of upper and lower radial bearings 31, such as shown in the above Garrison patent. Thrust bearings 32 and 33 whose function is as is conventional for this type of drills, as shown in the above Garrison or Neilson patents and is fully described in my copending applications, Ser. No. 354,954 and Ser. No. 385,836 which are herewith incorporated by this reference, now U.S. Pat. Nos. 3,857,655 and 3,894,818, respectively.

In FIG. 1, the housing section 5 is connected to the housing 6 and the housing 6 to the housing 29 by a tubular coupling 30 of internal diameter greater than housings 5, 6, and 29 to provide for the travel of the universal joints.

Drilling mud as is usually employed in this type of drilling operation is introduced through the drill string 2 and through the by-pass valve 3; and it passes between the stator 4, the rotor 8, discharges from the stator 4 to pass through housing 30 around the connecting rod 13 and rod 16 and enter into the stator 7 to pass between the rotor 9 and the stator 7 to discharge from the end of stator 7 and pass around the connecting rod 22 to enter the ports 28. Part may be bypassed around the shaft 27 and through grooves in the radial bearings 31 and thrust bearings 32 and 33 and the grooves of the lower radial bearing 31 and discharge from the end of the housing 29. The portion passing through the orifices 28 passes through the hollow drive shaft 27 to be discharged through the nozzles of the rotary bit 34 and then to be passed upwardly in the bore hole 1 in the annulus between the bore hole and the housings 29, 30, 6 and 5 and by-pass valve 3 and by the drill string 2 eventually to reach the top as is conventional in this type of drilling operation.

FIGS. 6–9 illustrate the critical dimensions of the stator-rotor assembly. It will be observed that the pitch length of the stator ($Ps$) is twice the pitch length of the rotor ($Pr$). Further, it will be observed that the cross-section of the stator is a bifoil consisting of two semicircles 36 and 37 connected by tangents 39. The center of the bifoil is at 43 (FIG. 8). The radius of the semicircle is equal to the radius of the rotor which has a circular cross-section of diameter D.

The vertical axis of the rotor is at 41. The rotor is symmetrical about this axis. The center 40 of each cross-section is on a helix parallel to the helical external surface 42. On rotation of 90° of the rotor clockwise as viewed at FIG. 7, the rotor translates to position shown in FIG. 8; at 180° rotates to position shown in FIG. 9.

The stator is formed of a double spiral groove 44 (FIG. 6) which conforms to the pitch of the rotor.

In moving by rotation and translation, the cavity at 45 is sealed by the rotor from all other cavities. As the rotor rotates and translates from the position in FIG. 7 to the position in FIG. 5, the cavity at 45 is connected with the cavity at 46 by the spiral groove in the stator. A further 90° rotation cuts off the cavity 45 from 46, closing cavity 45.

In translating and rotating the rotor executes an eccentric motion, such that a point 41 moves in a circular path of radius E, i.e., the eccentricity of the rotor motion.

The stator is composed of an interior interconnecting double spiral grooves 43 and 44, having a pitch ($Ps$) twice that of the pitch of the rotor ($Pr$).

It will be observed that the total flow of G.P.M. through each of the stators is the same.

The parameters E, D, and $Ps$ are related so that $$\text{r.p.m.} = \frac{G.P.M. \times 231}{4E \times D \times Ps}$$

with E, D, and P*s* in inches

Furthermore, the torque T is:

$$T = 0.636 \times E \times D \times Ps \times K \Delta p$$

$$K \Delta P = \Delta p$$

*T* is in inch-pounds and $\Delta P$ and $\Delta P$ are in pounds per sq. in.

The r.p.m. of the rotors in each assembly desirably should be substantially the same. Since some machining tolerances are necessary and since molding techniques are not so advanced as to equal machining precision, the exact equality of the products E × D × P*s* may not be obtainable. However, following good practice in these arts, a substantial equality may be obtained.

A further difficulty in not maintaining a substantial equality as has been referred to above arises from the fact that since the G.P.M. is the same for all motors should the product E × D × P*s* not be the same, while the G.P.M. is the same.

$$\text{r.p.m.} = \frac{G.P.M.}{4E \times D \times Ps}$$

The result is that a portion of the G.P.M. bypasses as leakage so that the effective $(G.P.M.)^1$ which causes rotation is again established the equality $$\text{r.p.m.} = \frac{(G.P.M.)^1}{4E \times D \times Ps}$$

The leakage plus the $(G.P.M.^1$ being the total throughput.

But to the degree that $(G.P.M.)^1$ is not equal to (G.P.M.) the effective pressure drop $\Delta p$ across the rotor is reduced, reducing the torque.

$$\text{The ratio } \frac{(G.P.M.)^1}{G.P.M.} = K \text{ the efficiency factor}$$

Should, however, this out-of-phase operation become excessive and due to the limited diameter of the connecting housings 30, the out-of-phase motion may reach 180°, in which case, the connectors connecting the connecting rod to the rotors will rub against the housing and thus introduce undesirable wear.

Following standard machining tolerances and molding operations, while they cannot assure absolute accuracy, the rotors may get out of phase to a limited degree; but the universals will compensate for such degree of out-of-phase operation without introducing undue stress.

It will be observed, also, that should the wear occur usually on the lower rotor-stator assembly, the lower unit may be disconnected by unscrewing the bit, unscrewing the housing 29 from the lower housing 30, and unscrewing the lower housing 30 from the housing 6, disconnecting the connector 20 from the rotor 9, and the housing 6 from the upper housing 30. The housing 6 and stator may be stripped over the rotor and replaced by a new stator which is pushed over the rotor. The units are reassembled. The total torque and horsepower are produced at the bit 34 via the shaft 27 with the design parameter E × D × Ps substantially the same for each rotor-stator assembly, the total torque is proportional to the total pressure drop between the entry to the upper stator 4 and the discharge from the last stator 7. This is substantially equal to the sum of the pressure drops at each stator, ignoring the minimal pressure drops in the housings 30.

Figure 4:
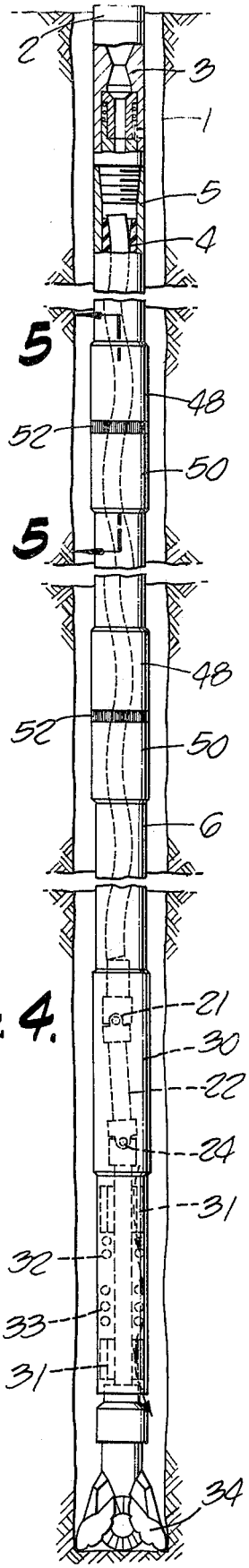
FIG. 4 shows schematically an alternative and preferred form of rotor and multiple stators.
Figure 5:
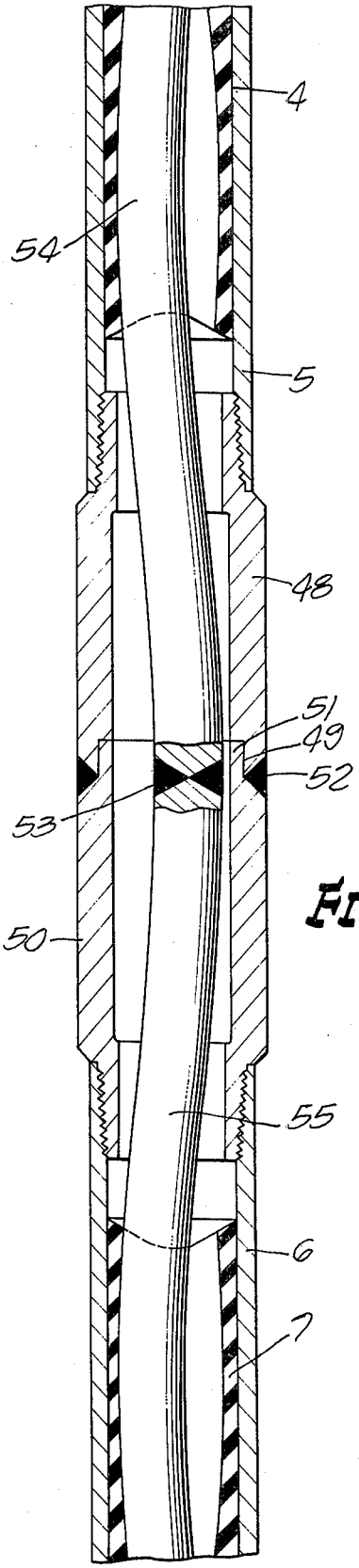
FIG. 5 is a partial section on line 5—5 of FIG. 4 showing one formed of rigid connection between the stator elements positioned in adjacent stators.
Figure 6:
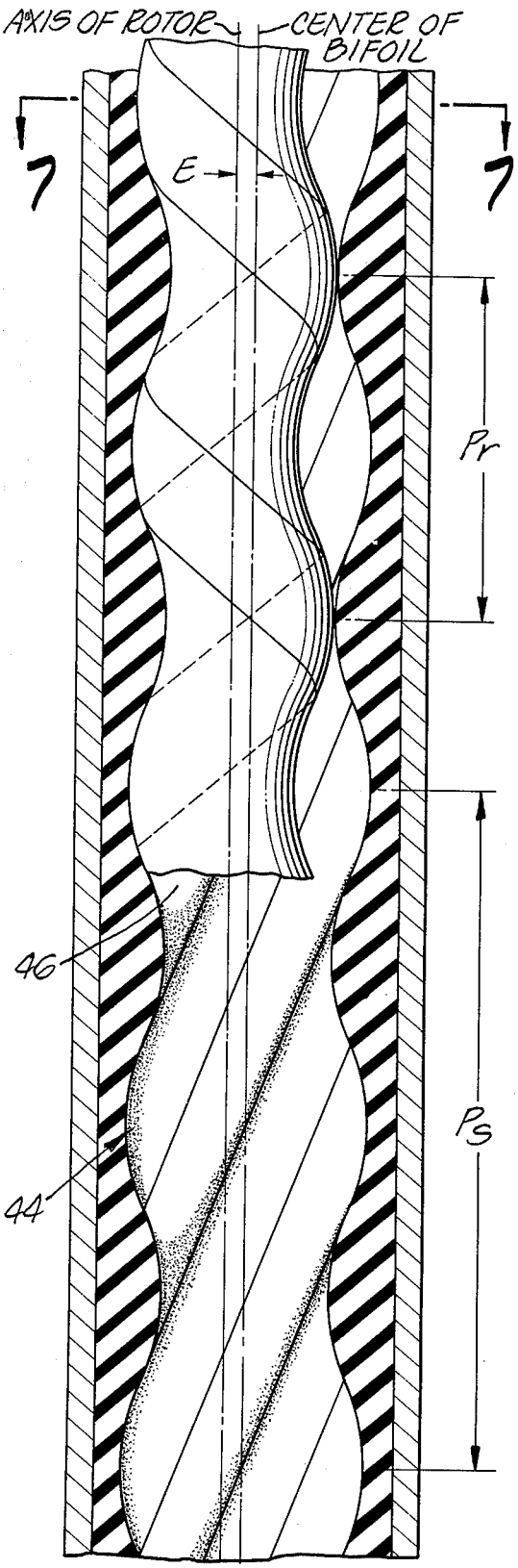
FIG. 6 is a vertical section through one stator and rotor element of the transducer of my invention which illustrates the design parameter.

FIGS. 4 and 5 illustrate a modification which constitutes the preferred embodiment of my invention.

The housings 5 and 6 are connected by the telescoping connector housings 48 and 50, the housing 50 nesting at 51 and 49 in the end of 48 and connected by a weld 52. Instead of a multiple of rotor elements connected by universal jointed connections as in the form shown in FIG. 1–3, the several rotor elements are rigidly connected by welding as shown in FIG. 5 at 53.

Instead one continuous rotor may be fabricated, but this adds to manufacturing difficulties in producing a long rotor. The segmental rotor formed in sections and assembled as in FIG. 5 is satisfactory. The assembled rotor is used as a guide and the housings and connector housings pushed over the rotor and assembled as shown.

This is illustrated in FIGS. 4 and 5 in which the rotor 54 is formed of sections, and extends to the top of the stator 4 and extends below the end of the stator 4 half way into the housing 48–50. The rotor section 55 extends into and is connected by welding at 53 to the rotor section 54 and extends through the stator 7 where it is connected by means of the connecting rod 22, universal joint 21, and universal joint 24 to the hollow shaft 27 in the same manner as described in connection with FIGS. 1, 2, and 3.

Should it be desired to use stator units in addition to the two illustrated, a second connector such as 48–50 is introduced between the stator housing 5 and the stator housing 6.

It will be observed that with such a unit it is assured that the rotor or portions of the rotor rotate at the same r.p.m. and cannot get out of phase. Since the eccentricities of the rotor-stator assemblies should be alike and desirably also the pitch of the stator and the diameter of the rotor be the same, the stators are interchangeable.

I claim:

1. A progressing cavity fluid motor assembly comprising a plurality of separate stator elements, an internal helical groove in the internal surface of said stator elements, tubular means to connect the output end of one of said stator elements with the input end of an adjacent stator element in series into a continuous fluid passageway, a helical rotor element in each stator element, means to connect said rotor elements in said tubular means into a rotor assembly for simultaneous rotation, a fluid flow connection to the first of said stator elements in said series, a fluid flow connection to the last of said stator elements in said series, the pitch of said stator groove (P*s*) being twice the pitch of the rotor (P*r*), and in which each of said rotor elements is adapted to move in a rotary and eccentric motion, in the stator elements, a shaft, bearing for said shaft, a universal joint between one end of said rotor assembly and said shaft, the other end of said rotor assembly being free.

2. In the transducer of claim 1, said means to connect said rotor elements for simultaneous rotation, being a universal joint connection between adjacent rotors in said series positioned in said tubular means.

3. In the transducer of claim 2, in which the helical rotors have a circular cross-section and in which in each of the stator-rotor elements the product of the diameter (D) of the cross-section of the rotor, the eccentricity (E) of rotor motion in the stator-rotor combinations, and the pitch of the stator grooves (P*s*), to wit, (D × E × P*s*) being substantially the same in each of the stator-rotor elements.

4. In the transducer of claim 3, said means to connect said rotor elements for rotation, being a universal joint connection in said tubular means between adjacent rotors in said series.

5. In the transducer of claim 1, said connection between said rotors being a rigid connection between adjacent rotor elements in said series stator-rotor elements.

6. In the transducer of claim 5 in which the eccentricity of the rotor motion (E) in each stator element is substantially the same.

7. In the transducer of claim 6, in which the helical rotors have a circular cross-section, the product (D × E × P*s*), to wit, the product of the diameter (D) of the cross-section of the rotor, the eccentricity (E) of the stator-rotor combination, and the pitch of the stator grooves (P*s*) being substantially the same in each of the stator-rotor elements.

8. In the transducer of claim 3 in which the pitch (P*s*) of the stator grooves in each of the stator elements in said series are all substantially equal.

9. In the transducer of claim 8, said means to connect said rotor elements for simultaneous rotation, being a universal joint connection between adjacent rotors in said series.

10. In the transducer of claim 8, said connection between said rotors being a rigid connection between adjacent rotors in said series.

11. In the transducer of claim 3 in which the diameter of the rotors (D) in each of the stator elements are all substantially equal.

12. In the transducer of claim 11, said means to connect said rotor elements for simultaneous rotation, being a universal joint connection between adjacent rotors in said series.

13. In the transducer of claim 11, said connection between said rotors being a rigid connection between adjacent rotors in said series.

14. In the transducer of claim 7 in which the pitch (P*s*) of the stator grooves in each of the stator elements in said series are all substantially equal.

15. In the transducer of claim 14, said means to connect said rotor elements for simultaneous rotation, being a universal joint connection between adjacent rotors in said series.

16. In the transducer of claim 14, said connection between said rotors being a rigid connection between adjacent rotors in said series.

17. In the transducer of claim 7 in which the diameter of the rotors (D) in each of the stator elements are all substantially equal.

18. In the transducer of claim 17, said means to connect said rotor elements for simultaneous rotation, being a universal joint connection between adjacent rotors in said series.

19. In the transducer of claim 17, said connection between said rotors being a rigid connection between adjacent rotors in said series.

20. In the transducer of claim 3 in which the diameter (D) and the eccentricity (E) and the pitch (P*s*) are all substantially equal.

* * * * *